US009272826B2

(12) United States Patent
Santarelli et al.

(10) Patent No.: US 9,272,826 B2
(45) Date of Patent: Mar. 1, 2016

(54) CLOSURE WITH LOCK MECHANISM FOR FLUID PRODUCTS

(75) Inventors: Marcelo Santarelli, Buenos Aires (AR); Timothy M. Mazurkiewicz, Milwaukee, WI (US); Luis Agustin Barrera, Buenos Aires (AR); Hernan Gabriel Torres, Buenos Aires (AR)

(73) Assignee: MBF EMBALAGENS LTDA. (BR)

( * ) Notice: Subject to any disclaimer, the term of this patent is extended or adjusted under 35 U.S.C. 154(b) by 0 days.

(21) Appl. No.: 14/127,530

(22) PCT Filed: Jan. 30, 2012

(86) PCT No.: PCT/BR2012/000020

§ 371 (c)(1),
(2), (4) Date: Dec. 19, 2013

(87) PCT Pub. No.: WO2013/113079

PCT Pub. Date: Aug. 8, 2013

(65) Prior Publication Data

US 2014/0332533 A1 Nov. 13, 2014

(51) Int. Cl.
*B65D 51/24* (2006.01)
*B65D 47/24* (2006.01)

(52) U.S. Cl.
CPC ..... *B65D 51/24* (2013.01); *B65D 47/243* (2013.01)

(58) Field of Classification Search
CPC .. B65D 51/24; B65D 47/243; B65D 41/0485; B05B 11/0048; B05B 11/3064; B05B 11/3036; B05B 11/3032; B05B 11/3004
See application file for complete search history.

(56) References Cited

U.S. PATENT DOCUMENTS 5,862,955 A 1/1999 Albini et al.
6,814,263 B2 11/2004 Rosenthal

FOREIGN PATENT DOCUMENTS

BR PI0601387-2 A 12/2007
BR MU86009729 U 1/2008

OTHER PUBLICATIONS

International Search Report—PCT/BR2012/000020—International File Date: Jan. 30, 2012; MBF Embalagens LTDA.; 2 pgs.

*Primary Examiner* — Andrew Perreault
(74) *Attorney, Agent, or Firm* — Schmeiser, Olsen & Watts, LLP

(57) ABSTRACT

A closure with a locking mechanism, particularly developed for containers or packaging of fluid products with different consistencies, said closure provided with ergonomic lines which facilitate its handling and further provided with a locking mechanism consisting of a locking pin and a housing to protect the content of the container, safeguarding its properties for a longer period of time, and protecting the user during handling of said dispenser, is provided.

6 Claims, 5 Drawing Sheets

CLOSURE WITH LOCK MECHANISM FOR FLUID PRODUCTS

FIELD OF TECHNOLOGY

The following relates to a new closure with a locking mechanism, particularly designed for containers of fluid products of different consistencies and viscosities, including liquid products, pastes, etc., being particularly designed for medium to high viscosity products such as creams in general.

Cited closure particularly belongs to the field of devices designed for controlling the flow in packagings in general, and is provided with ergonomic lines that enables handling and with a locking mechanism to protect the content and safeguard its properties for a longer period of time, while protecting the user when handling cited packaging in order to prevent leaks when the user takes the product for travelling, or when goes to clubs or other locations.

BACKGROUND

Closures designed for product containers are generally made from a fairly usual solution provided with a base with fixing means to the container body and with closing means usually made of hinged lids that seals the packaging content, preferably through the pressure applied on the dispensing closure base against the container body.

Other types of closures for product containers are made of two distinct elements, namely, a base fixed at the nozzle or at the opening of the container, provided with an axial pin and a movable actuator with a hole corresponding to the axial pin, said actuator capable of performing vertical movements releasing or closing the hole.

This type of closures provided with a base and an actuator has some important drawbacks that should be highlighted.

The majority of closures of this nature is not equipped with a locking mechanism, and its actuator is capable of sliding vertically within its extension, without any control device, as it may happen when said packaging is carried inside a handbag or backpack. Due to the presence of other objects and the displacement of the user, the packaging may have its actuator involuntarily displaced by any one of these objects inside the handbag, releasing the hole and leaking part of the product, then causing inconveniences for the user.

Some closures have some type of locking devices, however, those devices disclosed in the prior art are usually innocuous or inefficient for not executing properly their intrinsic functions, causing leaks of the packaging content particularly when such packaging is carried by the user, whether inside a handbag, backpack, suitcase, etc.

In view of this fact, the applicants of this invention patent, active in the industry and commerce of packaging delivery systems for fluid products, observed the precariousness of this type of protection and sealing provided by existing closures for fluid dispensers.

Document PI0601387-2, filed on Apr. 5, 2006, entitled "CAP AND OVERCAP SET FOR BOTTLES IN GENERAL WITH "PUSH AND PUSH" SYSTEM FOR OPENING AND CLOSING WITH EASY" was idealized so that the user holds the container using one hand, opening and closing it with the finger, provided with a cap (1) that is attached to the neck of the container (F), equipped with a cylindrical projection (2) followed by a conical projection (3) with small openings (4) for the output of the product; to which a spring (5) engages; over which a cylindrical ring (6) fits with an external surrounding tab (7) at the bottom, with a diameter reduction at the top (8), comprising external vertical projections (9) with the upper end, beveled (10) in two phases, which receive the coupling of the cylindrical button (11) having a toothed contour (12) on the inside edge of the bottom, an internal cylindrical projection (13) followed by another small cylindrical projection (14) with an upper central hole (15), and vertical external rods (16) properly arranged, all this assembly being overlapped by a cylindrical overcap (17) comprising internal ribs (18) and an upper central hole (19), followed by a cylindrical projection (20) containing inner rails (21) accompanied at the bottom by projections with a toothed lower end (22) interposed by vertical rails (23).

Document MU8600972-9, filed on 17 May 2006, entitled "CAP AND OVERCAP WITH "PUSH-PUSH" SYSTEM FOR OPENING AND CLOSING BOTTLES IN GENERAL", was designed to be opened and closed with the same hand that holds it, just with simple pressure movements carried out by one of the fingers, provided with a cover (1) that is attached to the neck of the container (F), equipped with an upper cylindrical projection (2) with a toothed ring (19) surrounding the outside of same, followed by another smaller cylindrical projection (3) at the center forming a recess (4), and a conical projection (9) equipped with small holes (10) for the product output, this cap (1) having also a sectioned disc projection (20) allowing a perfect coupling of the teeth (21) and the internal projections of the vertical rods (22) of the overcap (23), which is equipped with an inner central and circular opening (24), where the button (7) executes its ascent and descent movements, this button being equipped with a lower central cylindrical projection (6) and a small cylindrical projection (11) followed by a central hole (12) for the output of the liquid or paste product, its ascent and descent movements being activated by a spring(s) added to attach the external ring (15) through the teeth (16) next to the external surrounding frieze (13) supporting the lower edge (14) of the internal projections (17), whose teeth projections (18) articulate the movement of the same regarding the cap (1) over the toothed ring (19), and with regard to the cap (23) with the teeth (26) having a specific conformation, which provides a first step and a second step of movement present on the lower edge of the central internal cylindrical projection (25) that accompanies the circular central opening (24).

These devices execute their functions adequately unless they are exposed or displaced by the user inside a handbag, briefcase or backpack, when this occurs, the contents inside the product may leak at least partially.

SUMMARY

An aspect relates to a closure with a locking mechanism integrated to the fluid packaging, particularly developed to be applied on containers or packaging of fluid products with different consistencies, said closure being provided with ergonomic lines to facilitate its handling and also provided with a locking mechanism to protect the content of the packaging, safeguarding its properties for a longer period of time and protecting the user when handling of said packaging.

The use of this closure with locking mechanism for fluid containers in general is greatly simplified. To open and release the product from the container, the user needs to position his fingers along the recessed areas of the actuator, and make a light pressure to deform their tabs in order to release the locking pins of the base of the actuator housings, allowing said actuator to move axially upwards and allow the releasing of the content of the packaging.

For the closing of said closure, the user just needs to press the actuator down, engaging the locking pins again in their corresponding housings, thereby locking the whole assembly.

BRIEF DESCRIPTION

The subject matter of this invention will become fully clear in its technical aspects from the detailed description, which will be made based on the figures listed below, in which.

DETAILED DESCRIPTION

Figure 1:
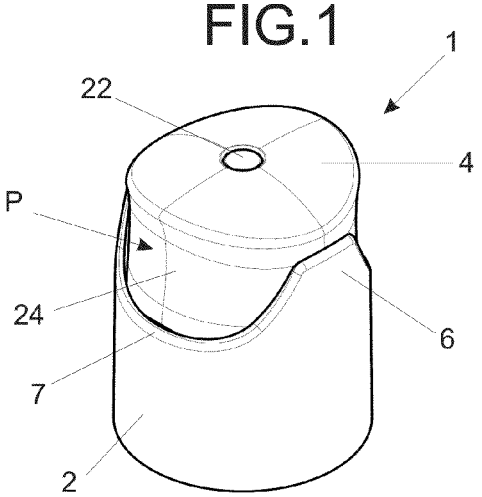
FIG. 1 shows a perspective view of the main model of the closure with locking mechanism for containers of fluid products, in the closed position.
Figure 2:
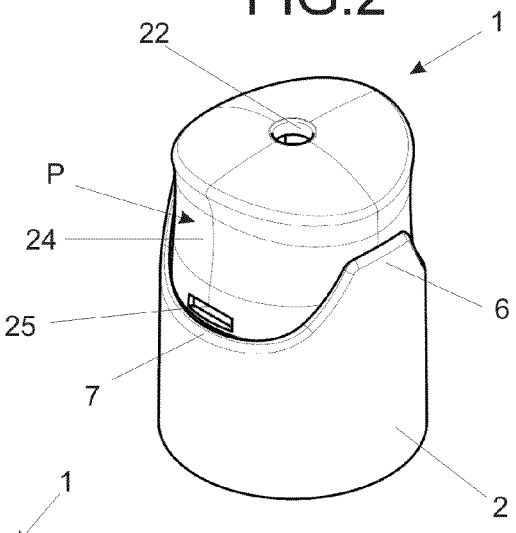
FIG. 2 shows a perspective view of the main model of the closure with locking mechanism for containers of fluid products, in the open position.
Figure 3:
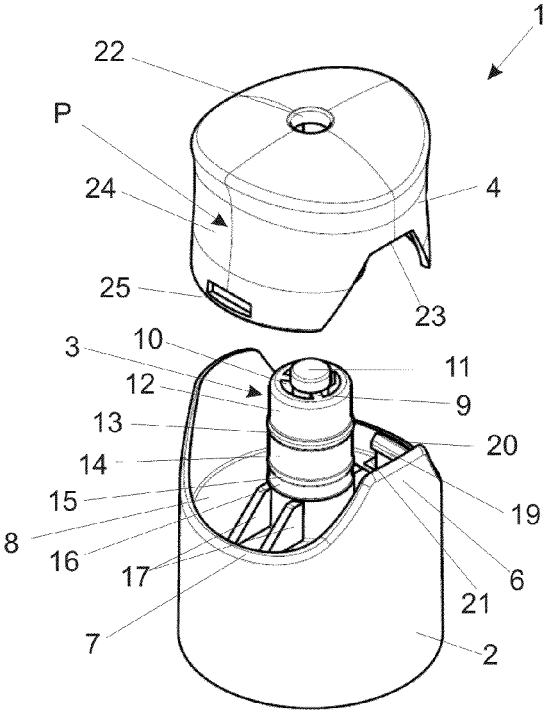
FIG. 3 shows an exploded perspective view of the main model of the closure with locking mechanism for containers of fluid products.
Figure 4:
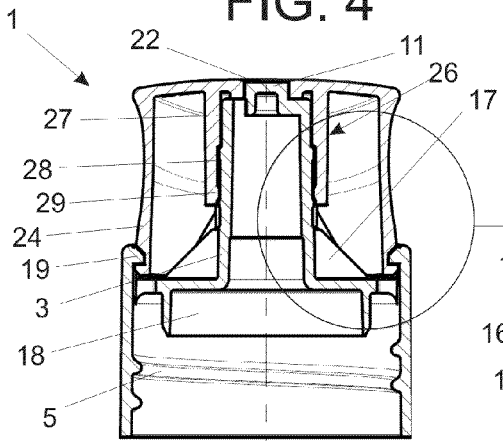
FIG. 4 shows a sectional view of the main model of the closure with locking mechanism for containers of fluid products, in the closed position.
Figure 4A:
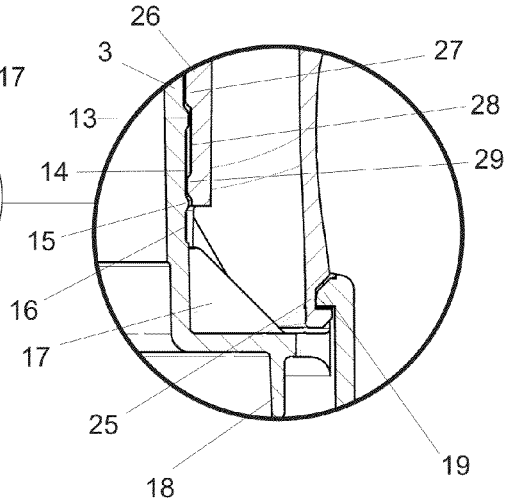
FIG. 4A shows a detail of the locking pin of the body of the main model of the closure positioned inside the actuator housing.
Figure 5:
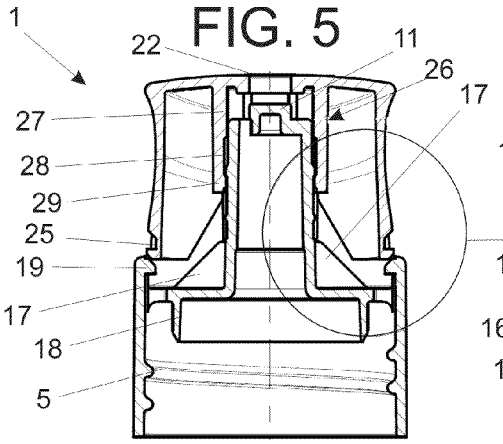
FIG. 5 shows a sectional view of the main model of the closure with locking mechanism for containers of fluid products, in the open position.
Figure 5A:
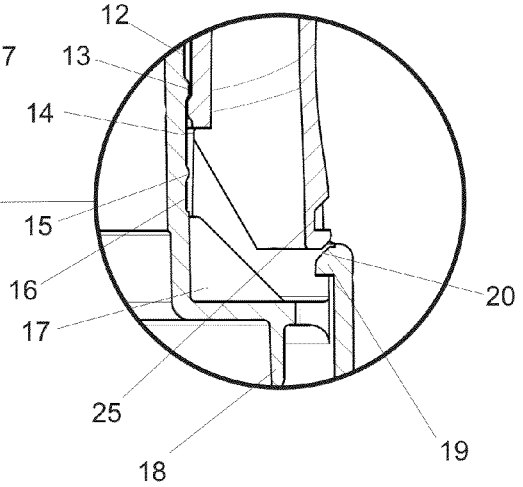
FIG. 5A shows a detail of the main model of the closure in the open position, showing the locking pin of the closure body positioned in the lower portion of the actuator housing.
Figure 6:
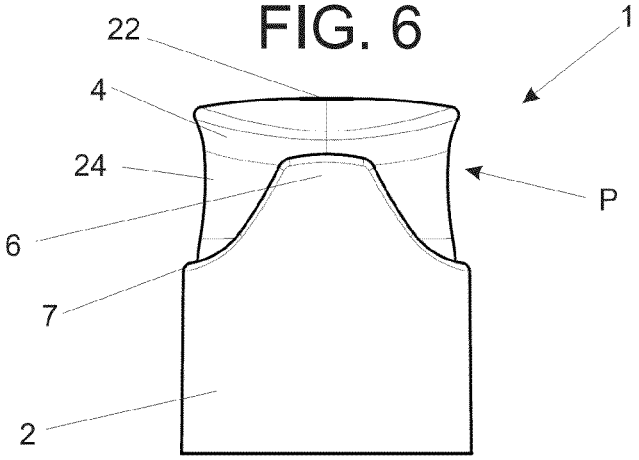
FIG. 6 shows a side view of the main model of the closure with locking mechanism for containers of fluid products, in the closed position.
Figure 7:
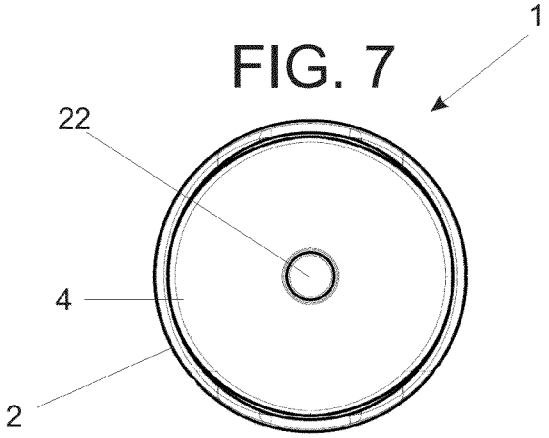
FIG. 7 shows a top view of the main model of the closure with locking mechanism for containers of fluid products, in the closed position.
Figure 8:
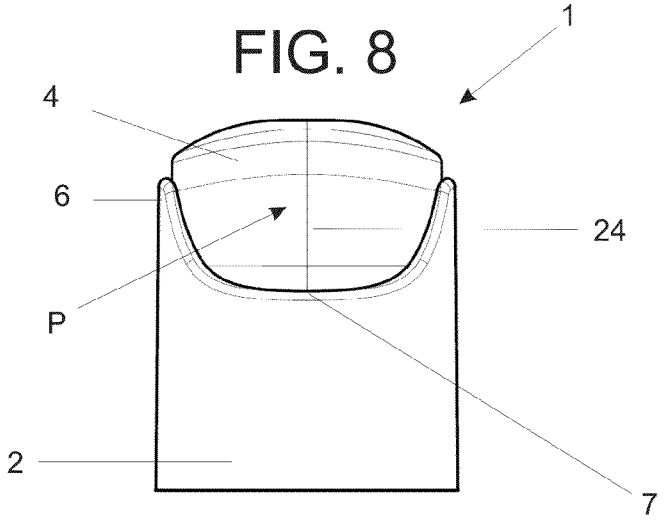
FIG. 8 shows a front view of the main model of the closure with locking mechanism for containers of fluid products, in the closed position.
Figure 9:
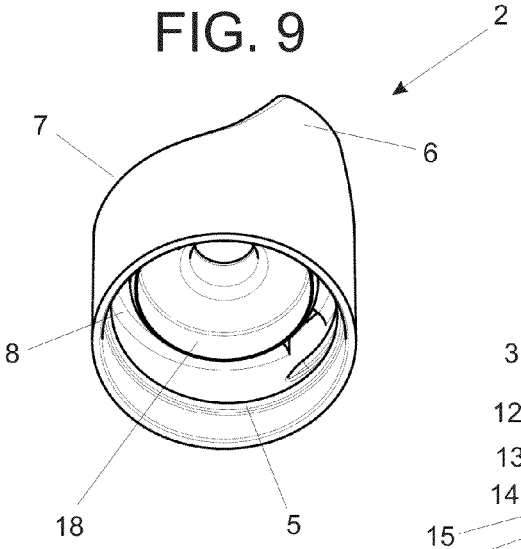
FIG. 9 shows a lower perspective view of the main model of the body of the main model of the closure with locking mechanism for containers of fluid products.
Figure 10:
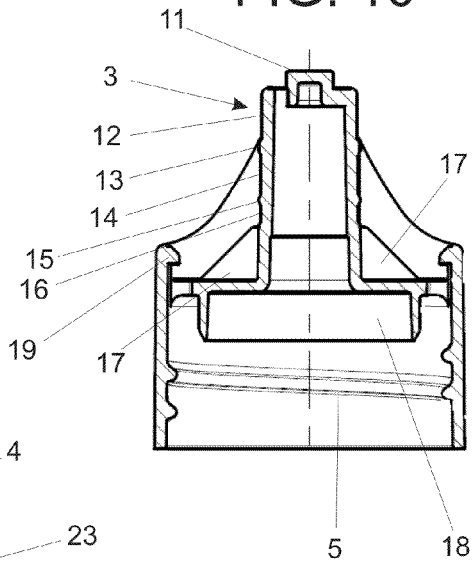
FIG. 10 shows a sectional side view of the body of the main model of the closure with locking mechanism for containers of fluid products.
Figure 11:
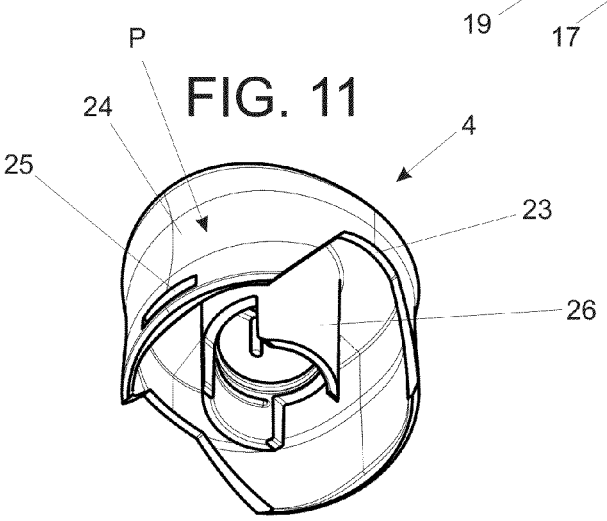
FIG. 11 shows a lower perspective view of the main model of the actuator of the closure locking mechanism for containers of fluid products.
Figure 12:
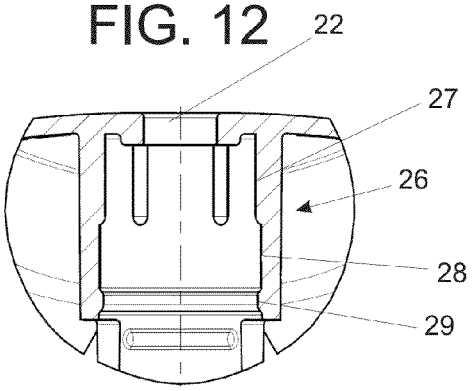
FIG. 12 shows a detail of the guide rib and the axial path area of the locking pin of the main model of the closure.
Figure 13:
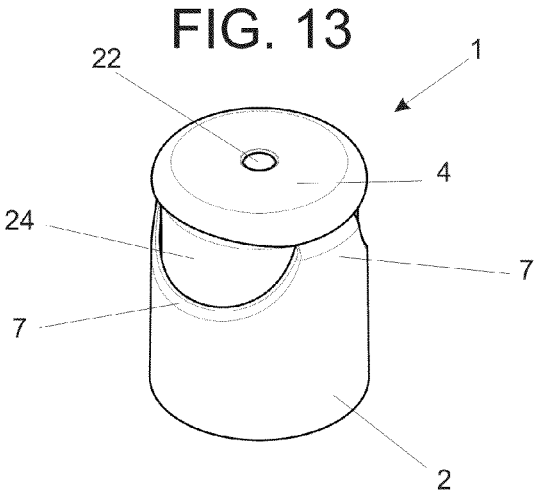
FIG. 13 shows a perspective view of an alternative embodiment of the closure.
Figure 14:
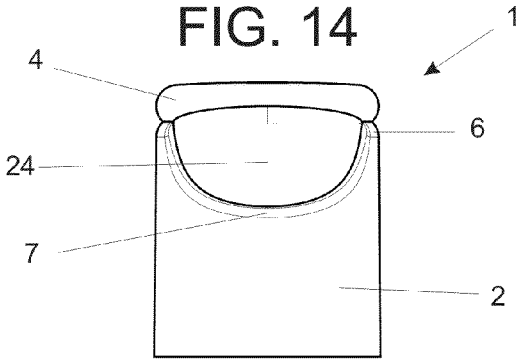
FIG. 14 shows a front view of an alternative embodiment of the closure.
Figure 15:
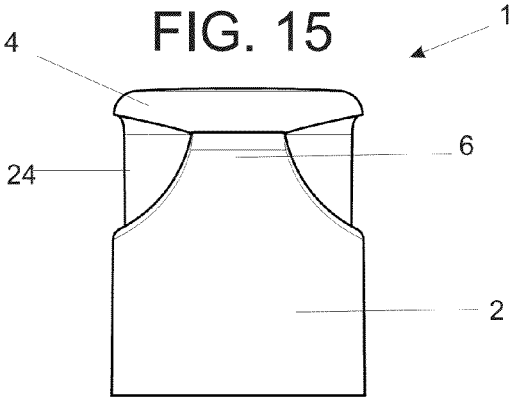
FIG. 15 shows a side view of an alternative embodiment of the closure.
Figure 16:
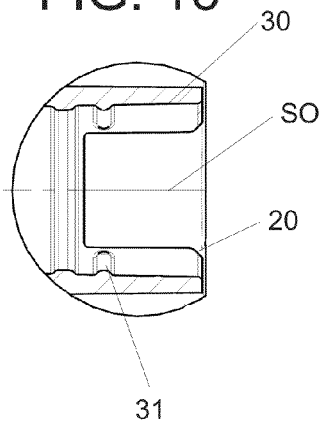
FIG. 16 shows a sectional view of an alternative embodiment of the closure, illustrating the orientation slot.

The above mentioned drawings show a closure 1 with locking mechanism, particularly developed to be applied on containers or packaging of fluid products with different consistencies, said closure being provided with ergonomic lines to facilitate its handling and also provided with a locking mechanism to protect the content of the packaging, safeguarding its properties for a longer period of time and protecting the user during handling of said packaging.

Said closure 1 with locking mechanism for containers of fluid products is made of thermoplastic material or other material with equivalent characteristics, showing a laminar structure and being constituted basically by two distinct elements interconnected among themselves, namely, a main body 2 and an external actuator 4 that engages partially inside the base of the body 2.

The base of the body 2 of the closure 1 with locking mechanism is preferably provided with a circular shape, with engaging means on the body of the dispenser, these means defined by a lower internal threaded profile 5 or other suitable fixing means, such as snap-on device, for example.

The upper sides of the body 2 of the closure 1 is provided with extensions 6 that extend upwardly, being interposed by two half-moon cutouts 7 at the front and rear faces, which establish a recessed area for the placement of the fingers of the user.

Internally, the base of the body 2 of the closure 1 has a transversal laminar element 8 fixed to its inner walls, providing a central hole from which a dosing spout 3 extends upwardly, equipped with radial ribs 9 at its upper end which form the product outlet holes 10, and said ribs 9 are joined centrally by a closing pin 11.

The body of this hollow push/pull dosing spout 3 shows, respectively from top to bottom, an upper entering area 12 for accommodating the actuator at the time of assembly during the production of the closure, an axial stroke limiting area 13, an axial stroke area 14, a closing limiting area 15 (click area) and a rest area 16 in the closed position.

Supported by the transversal laminar element 8, particularly at the base of the hollow dosing spout 3, there are at least four ribs 17 of an opening ramp compression latch arranged two by two and diametrically opposed to each other.

Said ramp ribs 17 have an important function in the opening process of said closure 1, since, when the user presses the recessed areas 24 of the deformable tabs P of the actuator 4, said tabs P, particularly its internal faces at the time of opening, touch and slide over the ramp ribs 17 directing the actuator 4 upwards and opening the product output hole.

On the lower part, this transversal laminar element 8 has a plug seal 18 to assist the sealing of said closure 1, at the mouth of the fluid container.

Each of the lower internal and central portions of the half-moon cutouts made in the body of the closure base has a compression locking pin 19, said pin provided with an entering chamfer 20 of the compression locking pin 19, and also a lower lateral hole 21 for the molding of said compression locking pin 19.

On the upper part, the closure 1 with locking mechanism shows an actuator 4 which engages partially inside the body 2 of the closure 1 base, during its initial closed position.

Said actuator 4 also shows a central upper through hole 22, that engages with the corresponding closing pin 11 present at the upper end of the hollow dosing spout 3 and, moreover, there are provided two weakening side slots 23, corresponding to the lateral extensions 6 of the base of body 2 of said closure 1 with locking mechanism, said slots 23 allowing the tabs P to deform inwardly when the user applies pressure over the recesses 24. The front and rear portions of said actuator 4 show slight lowerings 24 named recesses, which are part of the tabs P and allow a perfect fitting of the thumbs (fingers) of the user.

The center of the lower ends of each of the tabs P shows a through cutout of rectangular shape, named housing 25 for the opening of the compression latch, said housing 25 capable of receiving the compression locking pin 19 and to lock the assembly keeping it properly sealed.

Internally, said actuator 4 shows, particularly at its center, following the upper center hole 22, a tubular element or central collar 26 where the hollow dosing nozzle 3 engages partially in the body 2 of said closure 1, with the inner face of this tubular element or central collar 26 featuring, respectively from top to bottom, surrounding guiding ribs 27, an axial stroke area 28 and a ring 29 of axial stroke limit.

The central collar 26 of the actuator 4 also shows an entering area 30, a clicking area 31 and an orientation slot SO corresponding to the ramp ribs 17, avoiding the rotation of the actuator 4 in both the open and close positions of the closure 1.

The use of this closure 1 with locking mechanism for fluid containers in general is greatly simplified, and to open and release the product from the container, the user needs to position his fingers along the recessed areas 24 of the actuator 4, making a light pressure to deform the tabs P in order to release the housings 25 of the actuator 4 and the locking pins 19 of the base, before said tabs P find the ribs 17 of the ramp, allowing that said actuator 4 moves axially upwards allowing the releasing of the content of the container.

To close the closure 1, the user just needs to press the actuator 4 down, engaging the locking pins 19 again at their corresponding housings 25, thereby locking the whole assembly.

Although the present invention has been described in detail, it is important to understand that the same does not limit its application to the details and steps described. The invention is capable of other embodiments and can be realized or executed in a variety of ways. It should be understood that the terminology used herein has the purpose of description and not of limitation.

The invention claimed is:

1. A closure device for fluid products, the fluid products having different consistencies, the closure device being made of a thermoplastic material, the closure device comprising:

a main body, the main body having a circular shape, and including an engaging means configured to engage a fluid container, the engaging means defined by a lower internal threaded profile; and an external actuator that partially engages an inside surface of the main body when in an initial, closed position;

wherein the main body includes extensions that extend toward an upper end of the main body of the closure, the extensions being interposed by two half-moon cutouts, which establish a recessed area between the extensions;

wherein a transversal laminar element located within the main body is fixed to the inner surface of the main body, providing a central hole from which a dosing spout extends upwardly, equipped with a plurality of radial ribs at an upper end of the dosing spout, which form a plurality of openings between the plurality of radial ribs, the plurality of radial ribs being joined centrally by a closing pin;

wherein the external actuator moves with respect to the transversal laminar element, and at least four ribs positioned between the transversal laminar element and the inner surface of the main body, arranged two-by-two and diametrically opposed to each other;

wherein the transversal laminar element has a plug seal that is configured to actuate at a mouth of the fluid container, the plug seal being located proximate a bottom end of the transversal laminar element;

wherein the inner surface of the main body proximate the upper end of the main body includes a compression locking pin at each of the half-moon cutouts made in the main body, the compression locking pin defined by an entering chamfer, and a lower lateral hole located proximate the upper end of the main body;

wherein the external actuator has a central upper through hole, and two weakening side slots corresponding to the extensions of the main body, the two weakening side slots allowing two tabs to deform inwardly when a user applies a pressure to the two tabs;

wherein a housing is located at a center of the two tabs that receives the compression locking pin.

2. The closure device according to claim 1, wherein the external actuator moved with respect to the transversal laminar element, the transversal laminar element including an upper entering area, an axial stroke limit area, an axial stroke area, a closing limit area, and a resting area in a closed position, the upper entering area, the axial stroke limit, the axial stroke area, the closing limit area, and the resting area corresponding an upper central hole and a central tubular element of the external actuator equipped with an entering area, a clicking area and an orientation slot corresponding to the at least four ribs.

3. The closure device according to claim 1, wherein a movement of the external actuator is activated by the pressure applied by the user to the two tabs, which move inward and release the compression locking pin, and then slide against the at least four ribs, directing the external actuator upwards and releasing a product output hole.

4. The closure device according to claim 1, wherein the two tabs of the external actuator form a plurality of recesses.

5. The closure device according to claim 1, wherein, when the pressure is applied by the user, the compression locking pin is released, allowing an upward axial movement of the external actuator, and the closing of the closure device occurs with a pressure of the external actuator against the main body, engaging again the compression locking pin with the housing.

6. The closure device of claim 1, wherein the dosing spout is hollow.

* * * * *